United States Patent [19]

Gressett, Jr.

[11] Patent Number: 4,988,136

[45] Date of Patent: Jan. 29, 1991

[54] RETRACTABLE DOOR HANDLE MOTION TRANSFER MECHANISM

[75] Inventor: Charles A. Gressett, Jr., Eagle Rock, Calif.

[73] Assignee: Adams Rite Manufacturing Company, Industry, Calif.

[21] Appl. No.: 382,414

[22] Filed: Jul. 20, 1989

Related U.S. Application Data

[63] Continuation-in-part of Ser. No. 286,178, Dec. 19, 1988, Pat. No. 4,915,432.

[51] Int. Cl.[5] ..... E05C 21/02

[52] U.S. Cl. ..... 292/336.3; 292/244

[58] Field of Search ..... 292/244, 245, 336.3, 292/92, 21, 221

[56] References Cited

U.S. PATENT DOCUMENTS

| | | | |
|---|---|---|---|
| 3,011,330 | 12/1961 | Eads | 70/100 |
| 3,011,817 | 12/1961 | Eads | 292/140 |
| 3,214,947 | 11/1965 | Wikkerink | 292/92 X |
| 3,368,374 | 2/1968 | Eads | 70/100 |
| 3,689,159 | 3/1975 | Eads | 292/336.3 |
| 4,003,593 | 1/1977 | Wilzig et al. | 292/92 |
| 4,218,903 | 8/1980 | Eads | 70/107 |
| 4,458,928 | 7/1984 | Hirschbein | 292/92 |

OTHER PUBLICATIONS

See U.S. patent application, Ser. No. 237,182, filed Aug. 29, 1988.

Von Duprin, "Exit Devices Touchbar/Crossbar" (pp. 1-5) Monarch Hardware, 08716-MON, BuyLine 1293 (4 pages).

Corbin, "Exit Device Functions" (pp. 13-14).

"Sargent" Literature (2 pages).

"Russwin" Literature (1 page).

"Yale Exit Devies" Literature (1 page).

*Primary Examiner*—Richard E. Moore

*Attorney, Agent, or Firm*—William W. Haefliger

[57] ABSTRACT

Apparatus for transferring door opening or closing motion, in response to displacement of a door handle, comprises a mounting structure; the door handle carried by the mounting structure for push or pull displacement toward or away from the mounting structure; a rotary output element carried by the mounting structure; and motion transfer elements operable between the handle and the output element to effect rotation of the output element in response to the displacement of the door handle.

17 Claims, 15 Drawing Sheets

320
392a'
351
350
365
368
392a
369
397
313e
392
337
317
313
320a
313f
338
314
336
323a
391
323b
367
391a
311
312'
324b'
323
312
390
394a
393
390a
394
398
395

RETRACTABLE DOOR HANDLE MOTION TRANSFER MECHANISM

BACKGROUND OF THE INVENTION

This invention is a continuation-in-part of Ser. No. 286,178 filed Dec. 19, 1988, now U.S. Pat. No. 4,915,432, issued Apr. 10, 1990. This invention relates generally to door latch actuators and, more particularly, to an improved actuator enabling installation in different configurations to enable opening of the latch when the door handle is installed to be swung either clockwise or counterclockwise, and when the handle is installed "right-handed" or "left-handed", to be swung in either direction, as will appear. The invention also relates to motion transfer mechanism enabling a door to be opened when a handle is pulled or pushed, toward or away from a door.

When door latch actuators carrying handles are installed, it may be necessary to produce either clockwise or counterclockwise rotation of the actuator output shaft, depending upon the installation; and it is desirable that a single actuator mechanism be usable for this purpose. Also, it is desirable that that same actuator mechanism be installable for either left or right handed operation. There is need for a simple, rugged, easily adjustable mechanism that is "universal" in its adaptability to any of the above modes of operation. Further, it is desirable that door opening occur in response to single motion pushing or pulling of a door handle, as by a handicapped person's cane.

SUMMARY OF THE INVENTION

It is a major object of the invention to provide an improved latch actuating mechanism that is universal in its ability to be installed for operation in any of the above modes, i.e., to meet the above need. Basically, one form of the mechanism of the invention includes:

(a) a mounting means, (b) first, second and third elements carried by the mounting means, for movement relative thereto, the first and third elements coupled to the second element, the second element carried for bodily movement in response to rotation of the first element by the door handle, the third element being rotatable in response to bodily movement of the second element, (c) a rotary output element connected to the third element, and (d) at least two of the first, second and third elements having alternative coupling positions characterized in that in one position the output element is rotated clockwise when the handle is rotated clockwise, and in the other position the output element is rotated clockwise when the handle is rotated counterclockwise.

It is another object of the invention to provide for connection of the first element to the handle, and for connection of the third element to an output element in the form of a rotary shaft. In this environment, it is another object to provide the second element in the form of a linearly movable slider having grooves in which pins A and B are received, pin A carried by the first element and pin B carried by the third element.

It is a further object to provide such grooves, which receive the pins, to be parallel and to extend normal to the direction of linear movement of said slider. As will appear, each such groove may include two sections, respectively at opposite sides of a plane bisecting the grooves, at least one of the pins A and B being adjustably shiftable between the sections of its groove.

It is yet another object to provide a construction as referred to wherein the B pin is adjustably shiftable between the sections of its groove to reverse the direction of rotation of the rotary output element in response to rotation of the handle in a predetermined direction; and a further object is to provide a construction wherein the A pin is adjustably shiftable between the sections of its groove to permit usage of the handle on either side of the device.

A yet further object is to provide a locking part carried on the mounting means for movement into and out of locking position in which it blocks movement of one of said elements. As will be seen, the locking part typically blocks rotation of the first element in said locking position, as well as having a retracted position in which it limits rotation of the first element.

Another form of the mechanism of the invention includes:

(a) a mounting means, (b) the door handle carried by the mounting means for push or pull displacement toward or away from the mounting means, (c) a rotary output element carried by the mounting means, (d) and motion transfer elements operable between the handle and the output element to effect rotation of the output element in response to the displacement of the door handle.

In this modified form of the invention, the door handle typically has L-shape, including a first arm to be manually grasped, and a second arm projecting toward the mounting means, and a pivot connecting the second arm to the mounting means and extending transversely of the second arm whereby the first arm may be pulled away from the mounting means or displaced toward the mounting means.

Also, in the modified form of the invention, the motion transfer elements advantageously include first, second and third elements carried by the mounting means, for movement relative thereto, the first and third elements coupled to the second element, the second element carried for bodily movement in response to displacement of the first element by the door handle, the third element being rotatable in response to bodily movement of the second element, the rotary output element connected to the third element. As will be seen, a locking element may be carried on the mounting means for movement into and out of locking position in which it blocks such displacement of said handle relative to the mounting means.

These and other objects and advantages of the invention, as well as the details of an illustrative embodiment, will be more fully understood from the following specification and drawings, in which:

DRAWING DESCRIPTION

FIG. 1 is a perspective view of a mechanism incorporating the invention;

FIG. 1*a* is a diagrammatic view of the output shaft of the FIG. 1 mechanism, in door latch operating position;

Figure 1:
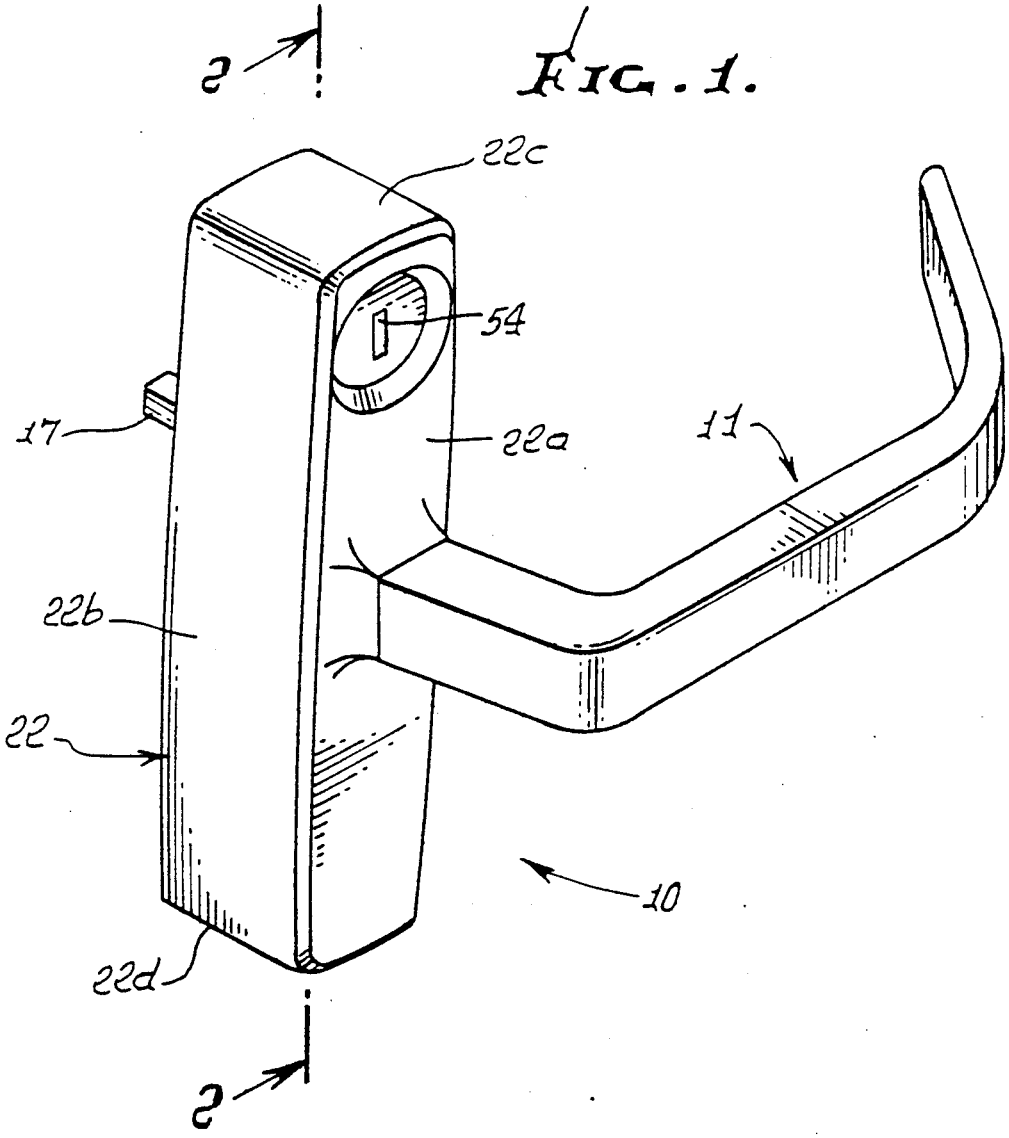
Figure 1A:
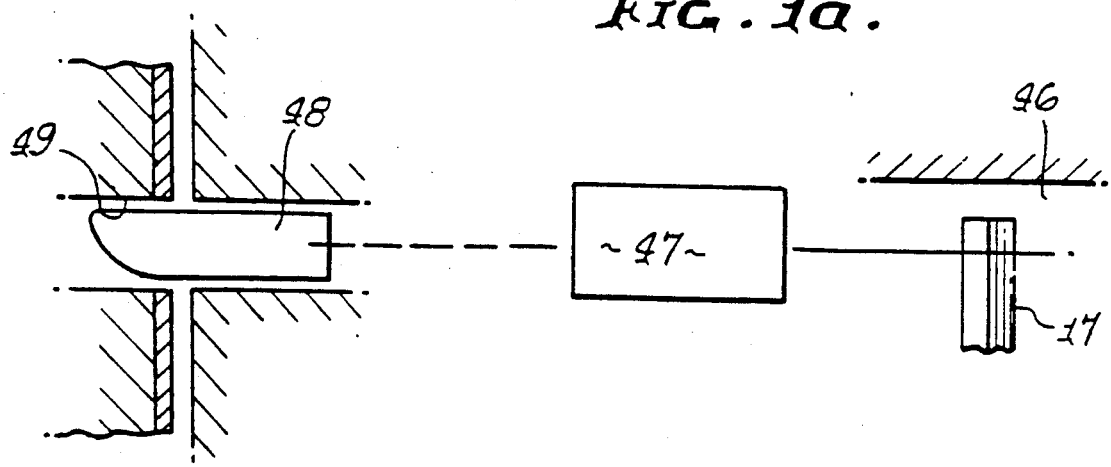
Figure 2:
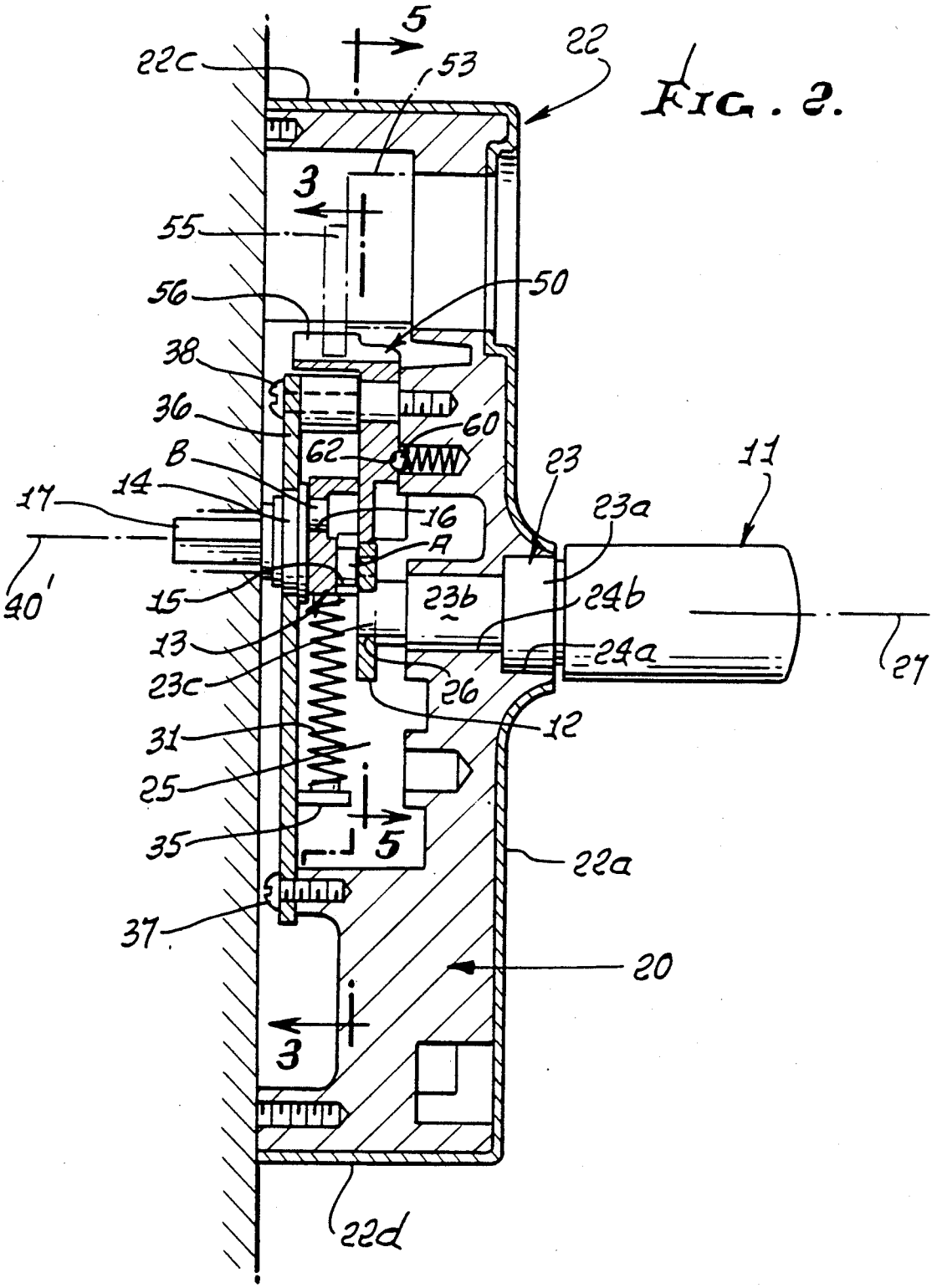
FIG. 2 is an enlarged vertical elevation, in section on lines 2—2 of FIG. 1.
Figure 21:
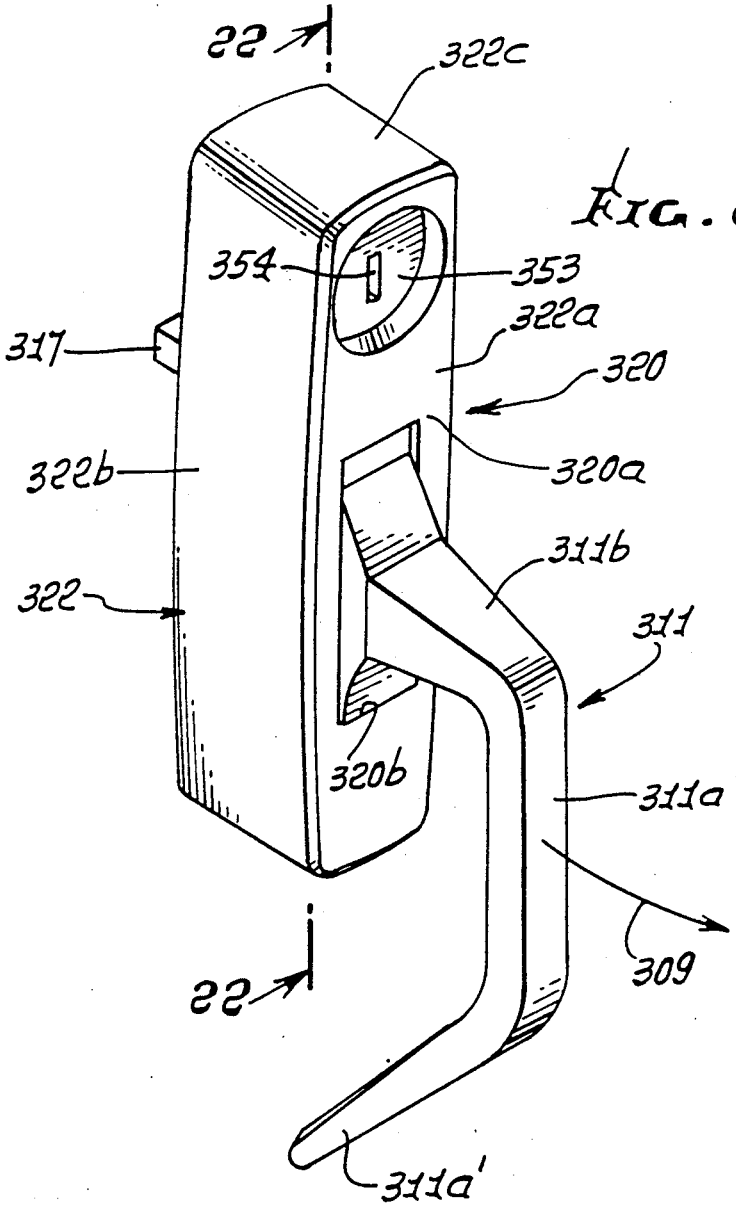
FIG. 21 is a view like FIG. 1 showing a modification.
Figure 21A:
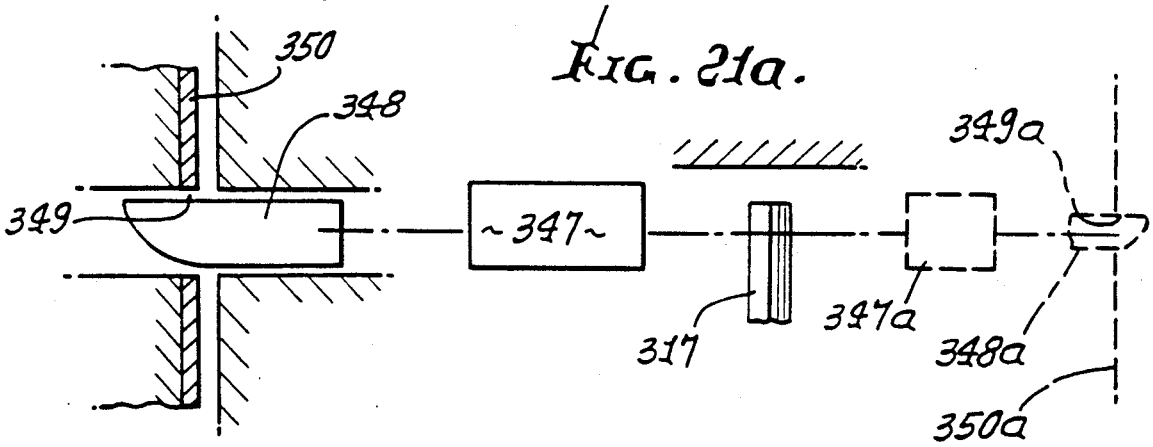

FIG. 21*a* is a view like FIG. 1*a;*

Figure 22:
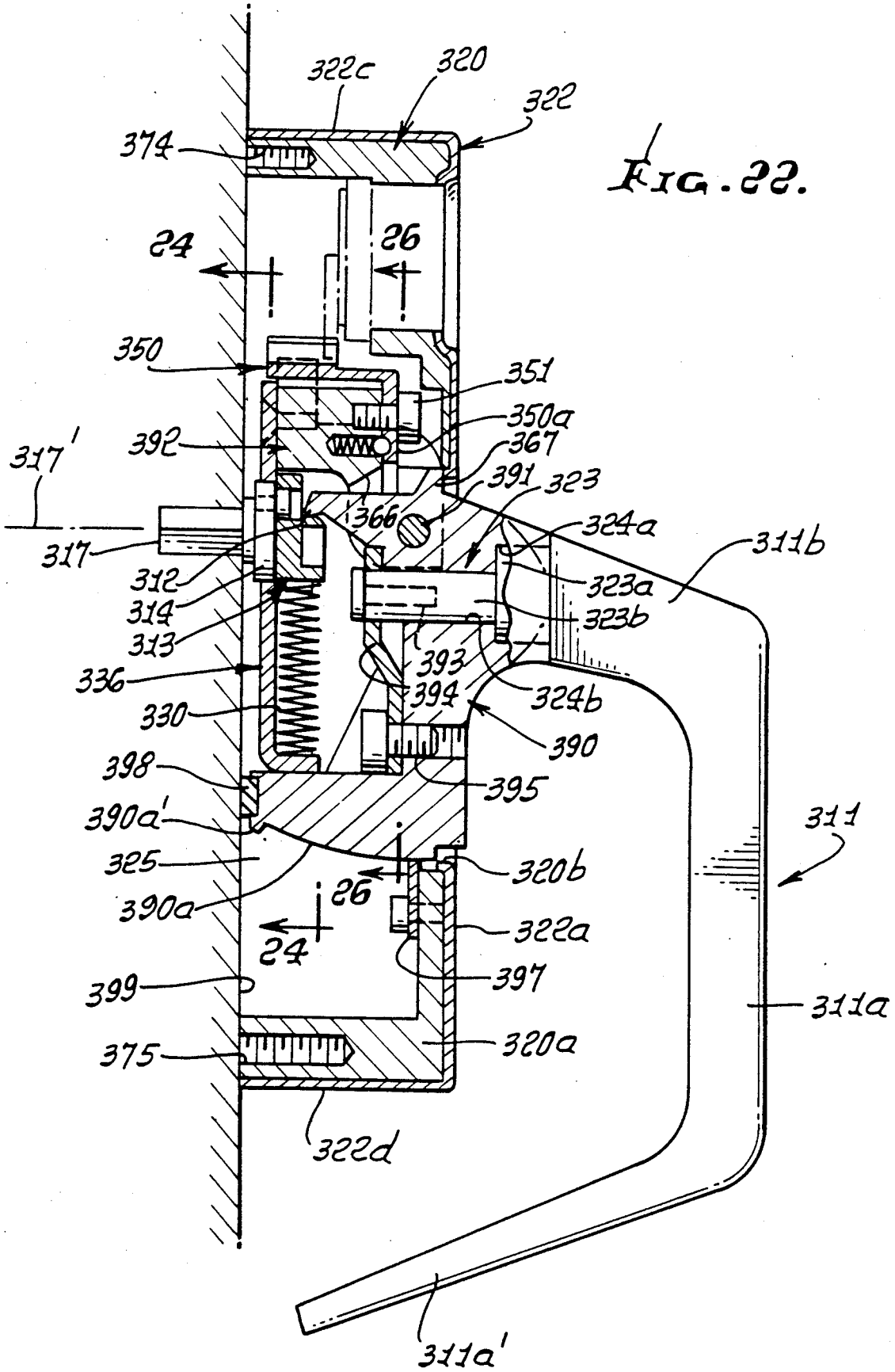
Figure 23:
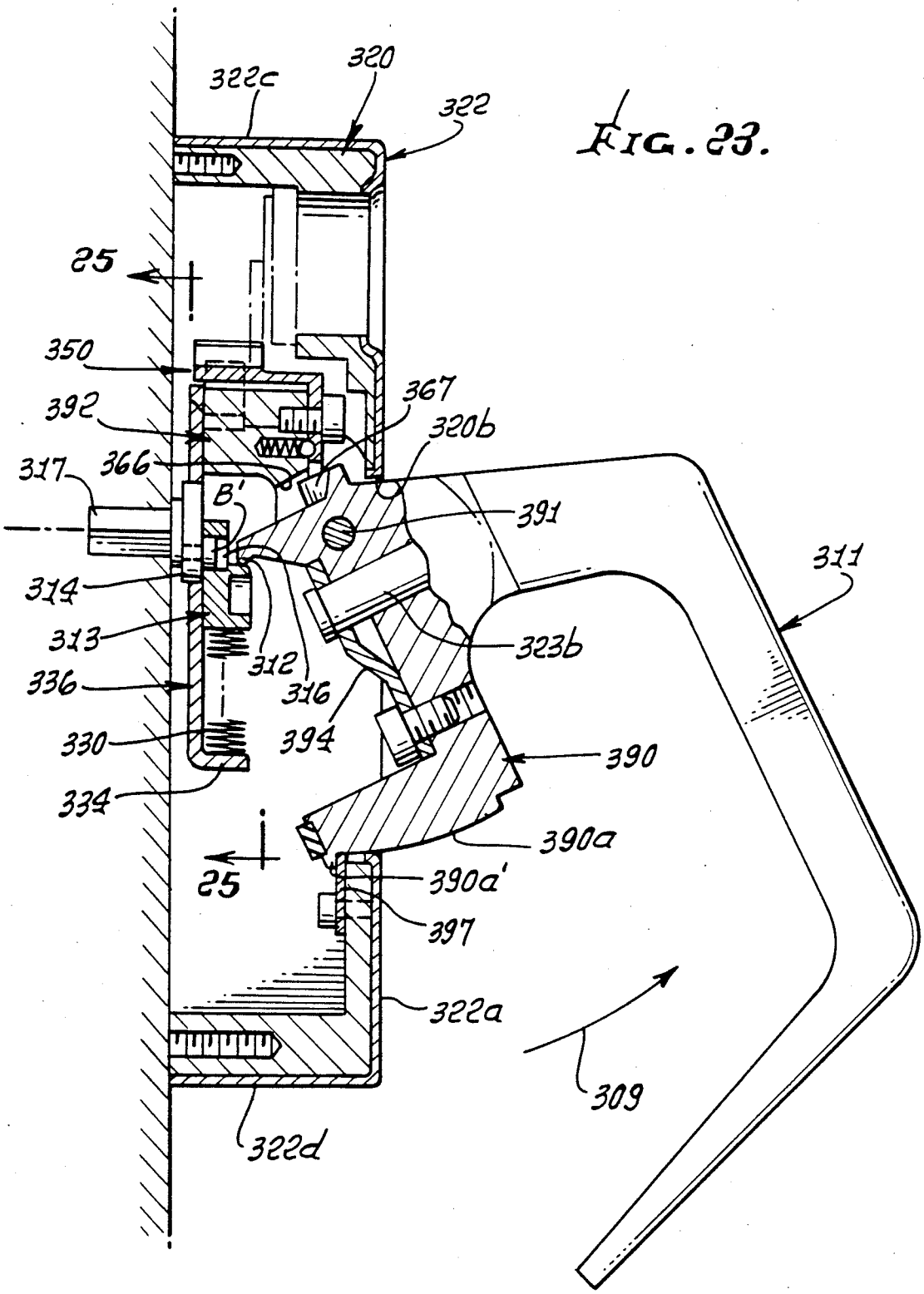
Figure 24:
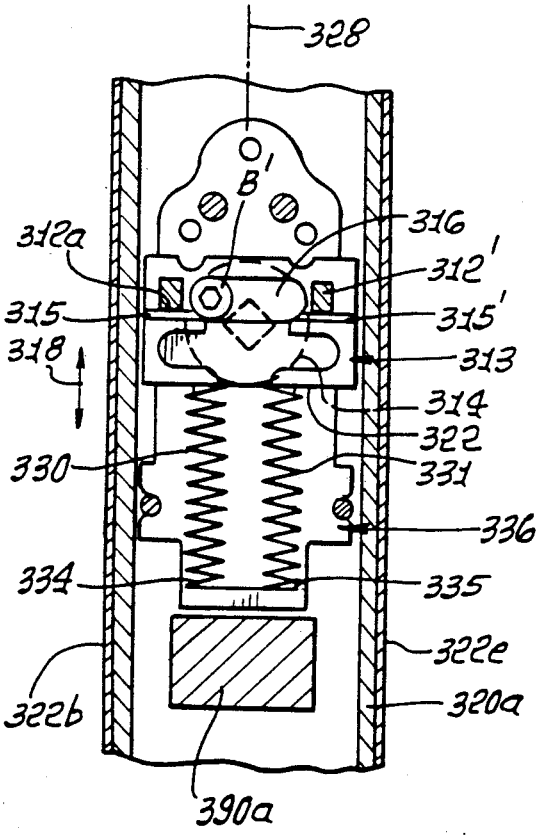
Figure 25:
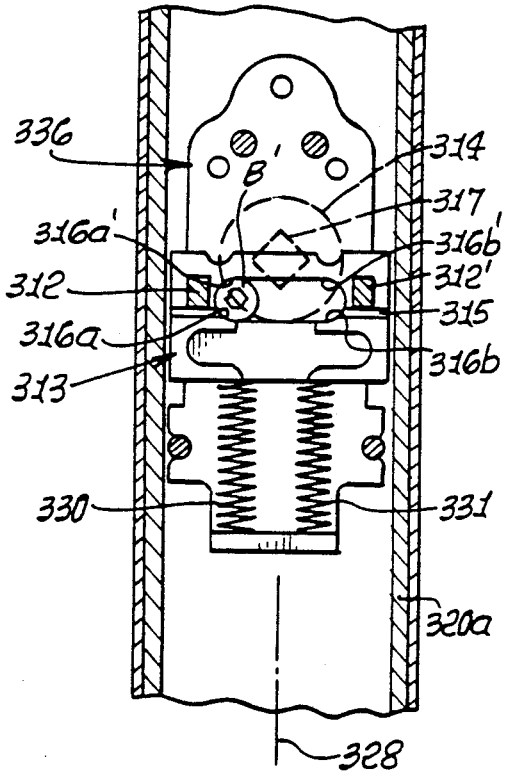
Figure 28:
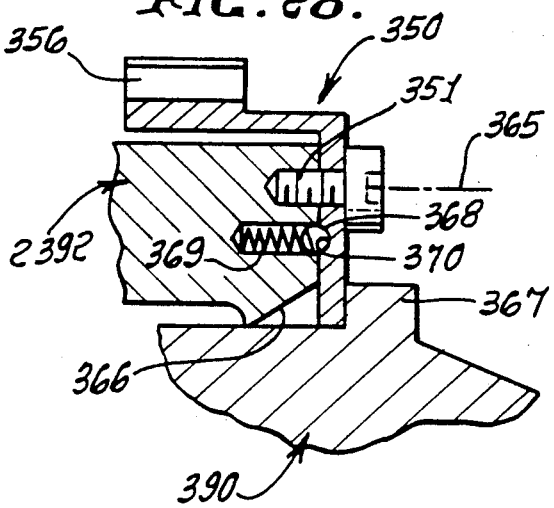
Figure 31:
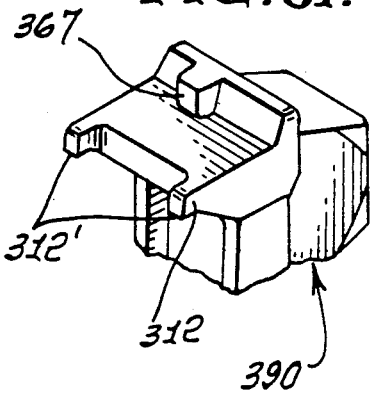
Figure 26:
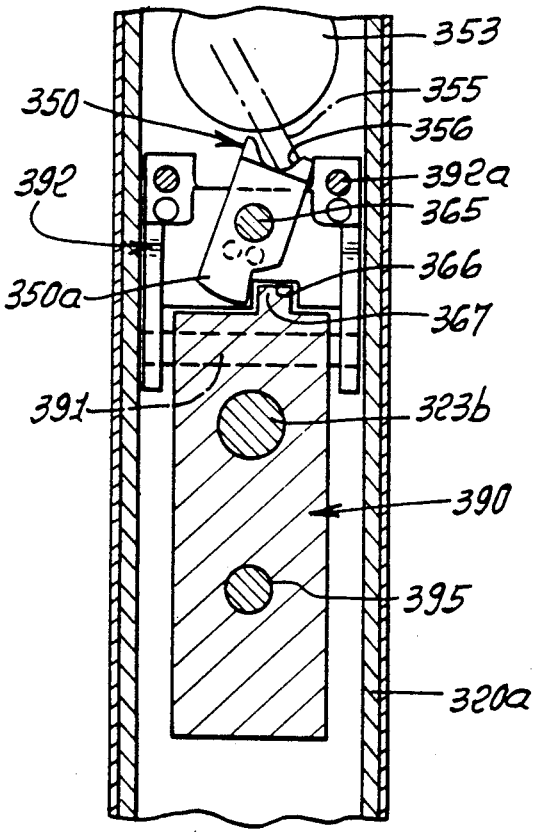
Figure 27:
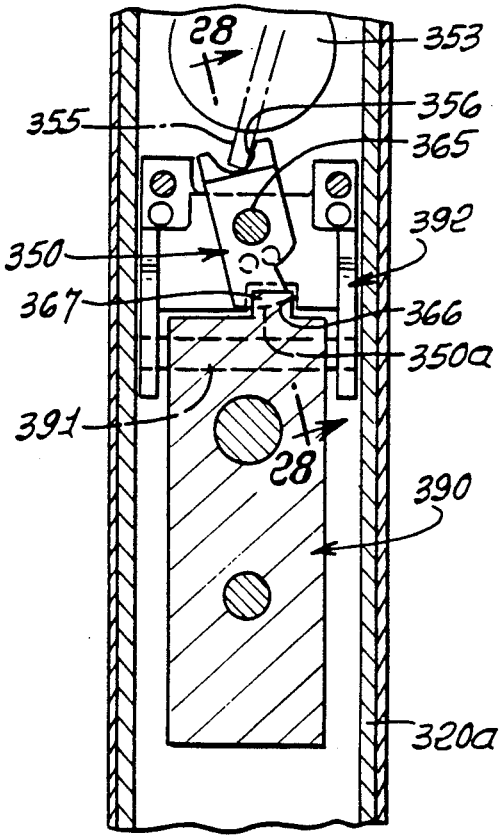
Figure 29:
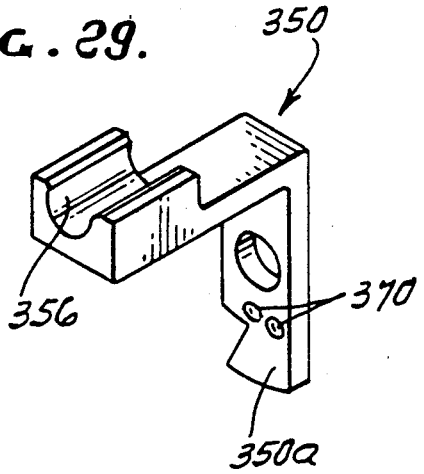
Figure 30:
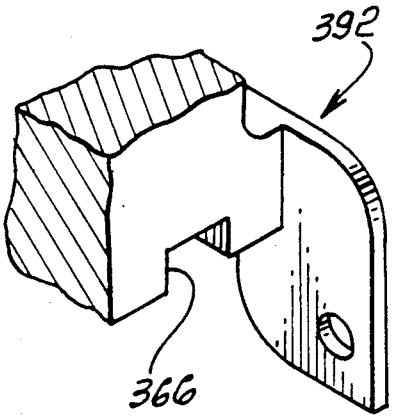
Figure 32:
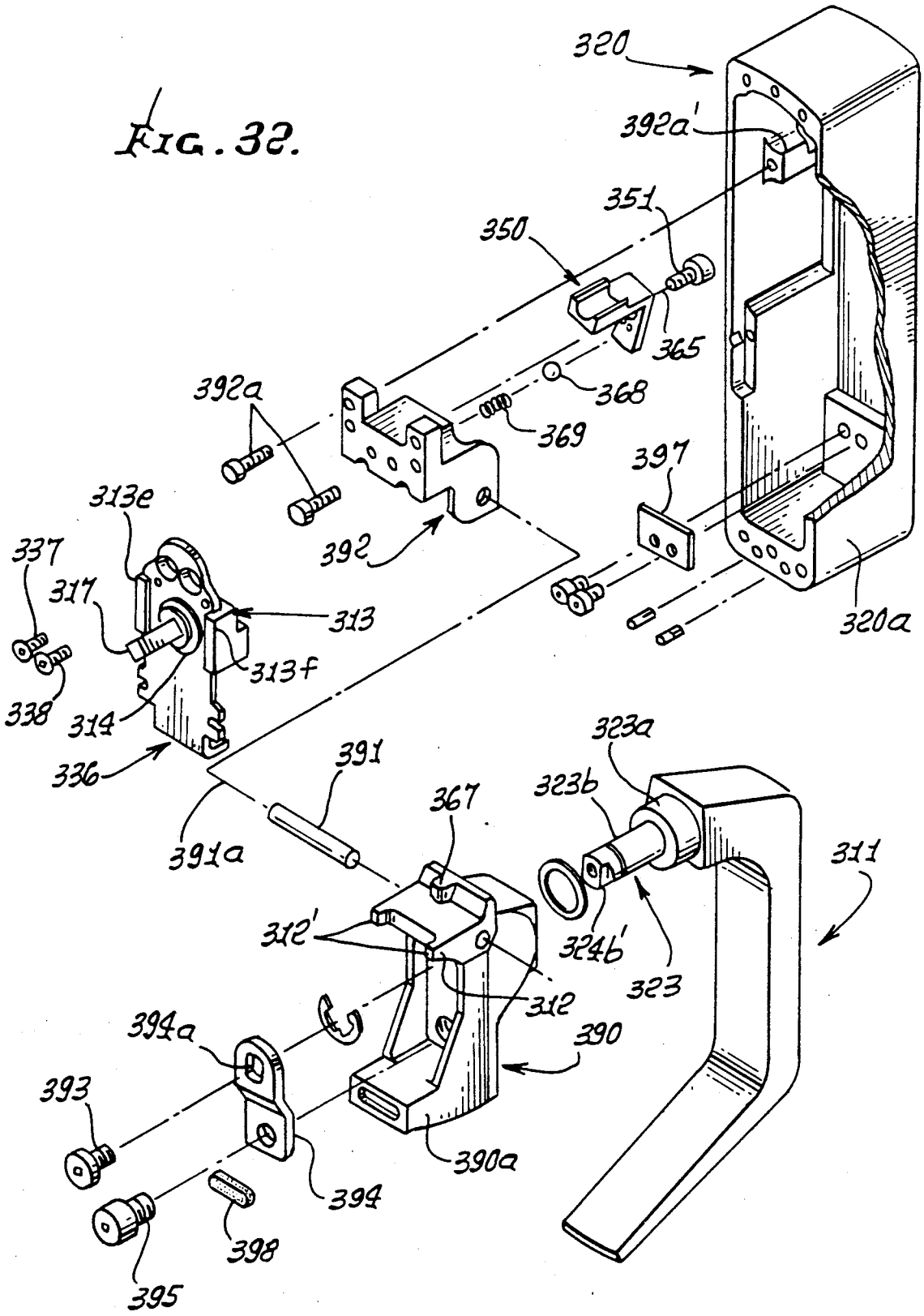

FIG. 22 is a section taken in elevation on lines 22—22 of FIG. 21;

FIG. 23 is a view like FIG. 22 showing handle retraction;

FIG. 24 is a frontal elevation on lines 24—24 of FIG. 22;

FIG. 25 is a frontal elevation on lines 25—25 of FIG. 23;

FIG. 26 is a section in elevation on lines 26—26 of FIG. 22;

FIG. 27 is a view like FIG. 26 showing locking configuration;

FIG. 28 is a section on lines 28—28 of FIG. 27;

FIG. 29 is a perspective view of a lock arm;

FIG. 30 is an enlarged perspective view of lock associated structure on a body;

FIG. 31 is an enlarged perspective view of lock associated structure on an actuator; and FIG. 32 is an exploded view of the FIG. 21-30 mechanism.

DETAILED DESCRIPTION

Figure 15:
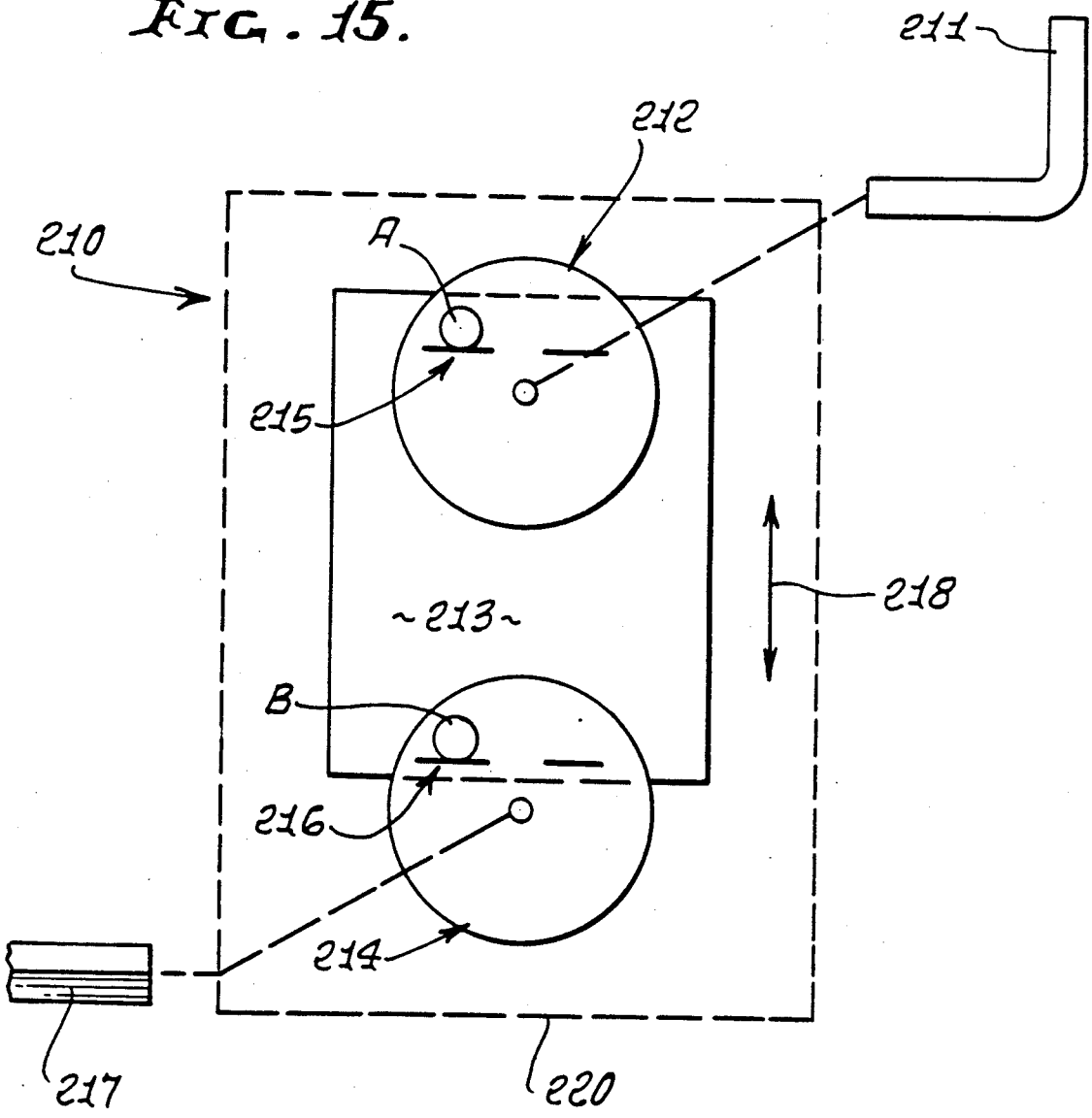
FIG. 15 is a diagrammatic view of basic elements.
Figure 11:
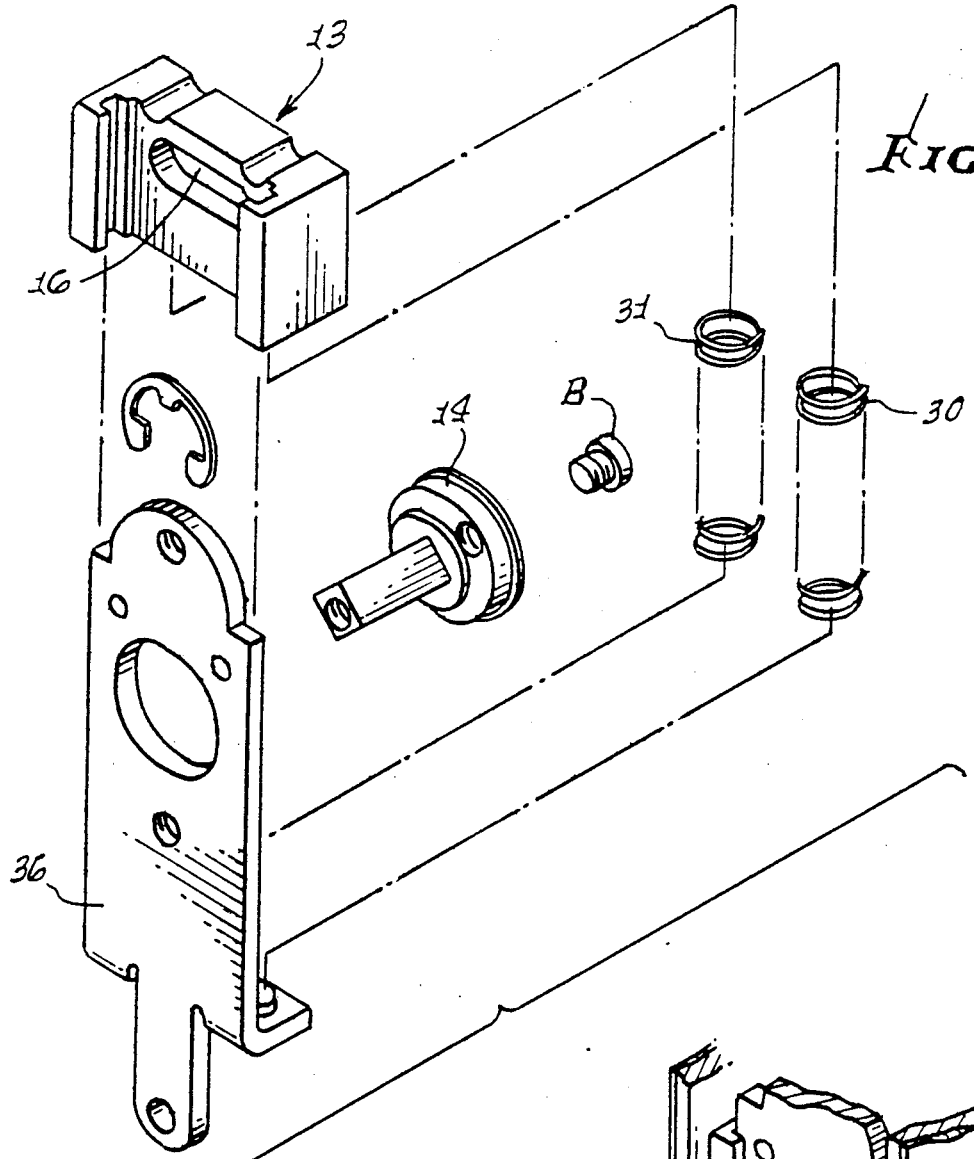
FIG. 11 is an exploded view of certain elements of the FIG. 1-10 mechanism.

Referring first to FIG. 15, the diagrammatic view of apparatus 210 for transferring door opening or closing motion, in response to rotation of a door handle 211, includes:

(a) a mounting means, indicated by the broken line block 220;

(b) first, second, and third elements (212, 213 and 214 respectively) carried by the mounting means for movement relative thereto, the first element 212 coupled to the second element 213 (as for example by a tongue and groove connection—pin A representing the tongue, and slot 215 in 212 representing the groove); the third element 214 also coupled to the second element 213 (as for example by a tongue and groove connection—pin B representing the tongue and slot 216 in 214 representing the groove); the second element 213 carried for bodily movement (sliding) in direction of arrows 218 in response to rotation of the first element 212 by the door handle; and the third element 214 being rotatable in response to bodily movement of the second element, as referred to, (c) a rotary output element 217 connected to the third element 214, (d) and at least two of the elements 212-214 having alternative coupling positions characterized in that in one of the latter the output element 217 is rotated clockwise when the handle is rotated clockwise (as in right-handed position) and in the other of the alternative coupling position, the output element 217 is rotated clockwise when the handle is rotated counterclockwise (as in left-handed position).

Referring now to the specific embodiment 10 shown in FIGS. 1-12 (other embodiments also being possible), the element-for-element correspondence with FIG. 15 is as follows:

| Element | FIG. 15 | FIGS. 1-12 |
|---|---|---|
| handle | 211 | 11 |
| mounting means | 220 (body) | 20 (body) |
| first element | 212 | 12 (drive rotor) |
| second element | 213 | 13 (slider or window block) |
| third element | 214 | 14 (driven rotor) |
| tongue | A (pin) | A (pin or rotor 12) |
| groove | 215 | 15 |
| tongue | B (pin) | B (pin or rotor 14) |
| groove | 216 | 16 |
| rotary output element | 217 | 17 (shaft) |

In FIGS. 1-12, the body 20 is elongated, and closely fits within a housing shell 22 having an outer face 22*a*, and skirt defining skirt side walls 22*b* and 22*e*, and end walls 22*c* and 22*d*. Shell is typically metallic and may be anodized. Attached to the handle is a shaft 23 including sections 23*a*, 23*b*, and 23*c*. Sections 23*a* and 23*b* fit within bores 24*a* and 24*b* in body 20, for rotation relative to the body as the handle is rotated.

The body 20 forms a recess 25 into which rotor or plate 12, slider (window) block 13 and rotor or plate 14 are received. Rotor 12 is attached at 26 to the end of drive shaft section 23*c* to rotate pin A eccentrically relative to the shaft axis 27. Pin A projects into the laterally elongated window groove 15 defining primary cam surface sections 15*a* and 15*b*, and also 15*a'* and 15*b'* (see FIGS. 3 and 4) at opposite sides of a vertical plane 28 bisecting the groove 15 and block 13. Groove 15 is formed by slider block 13, as a recess therein facing rightwardly in FIG. 2 toward rotor plate 12. Sections 15*a* and 15*b* may be referred to as C and D sections, with which pin A is associated.

Likewise, pin B carried by driven rotor 14 projects into laterally elongated window groove 16 defining secondary cam surface sections 16*a* and 16*b*, and also 16*a'* and 16*b'* (see FIGS. 3 and 4) at opposite sides of plane 28. Groove 16 is also formed by slider block 13, as a recess therein facing leftwardly in FIG. 2. Sections 16a and 16b may be referred to as E and F sections.

Pin A functions as a primary cam, engaging one or the other of the primary cam follower surface sections C and D to displace the block 13 downwardly (see FIGS. 3 and 4) as the handle is rotated clockwise downwardly; and pin B functions as a secondary cam follower, engaged by one or the other of the secondary cam surface sections E and F acting to displace pin B downwardly (see FIGS. 3 and 4) as the block is displaced downwardly by pin A. Such downward displacement of block 13 is resiliently or yieldably resisted by two compression springs 30 and 31 endwise confined between the undersurface 32 of the block 13 and ledges 34 and 35. The latter project from a mounting plate 36 attached via fasteners 37 and 38 to body 20. Plate 36 extends to a plane parallel to the up-down movement of block 13, the latter slidably guided in its movement between plate 36 and plate or rotor 12, and also between body walls 40 and 41 seen in FIGS. 3 and 4. As the handle is rotated downwardly from FIG. 3 to FIG. 4 position, pin B is displaced downwardly to rotate the rotor 14 about its axis 40', i.e, axis of output shaft 17, whereby pin B is also displaced laterally, from FIG. 3 to FIG. 4 position. As the turned handle is released, the springs act to return block 13 upwardly to FIG. 3 position, whereby the pins A and B also return to FIG. 3 position. Note that pin A is slidably confined between sections 15a and 15a', and pin B between sections 16b and 16b', (the shaft 17 rotating 90°).

Figure 3:
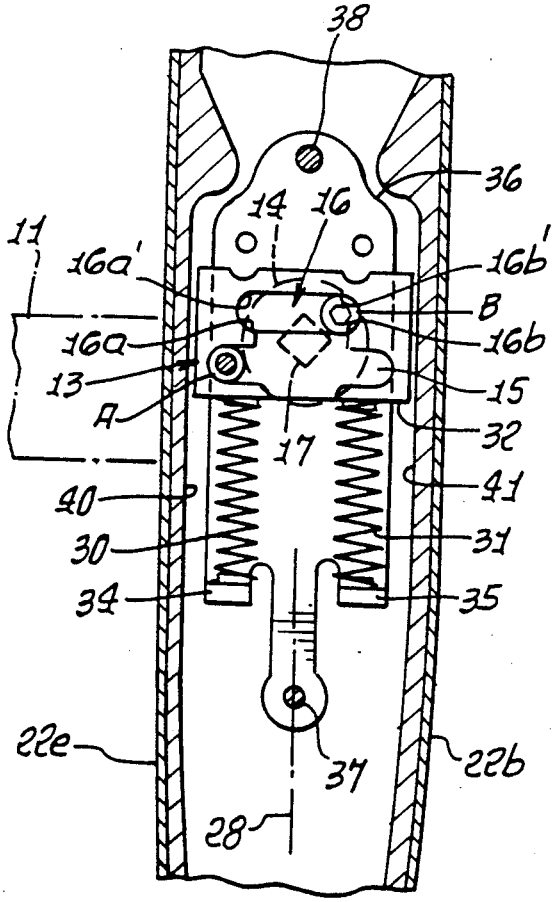
FIG. 3 is an elevation taken in section on lines 3—3 of FIG. 2.
Figure 4:
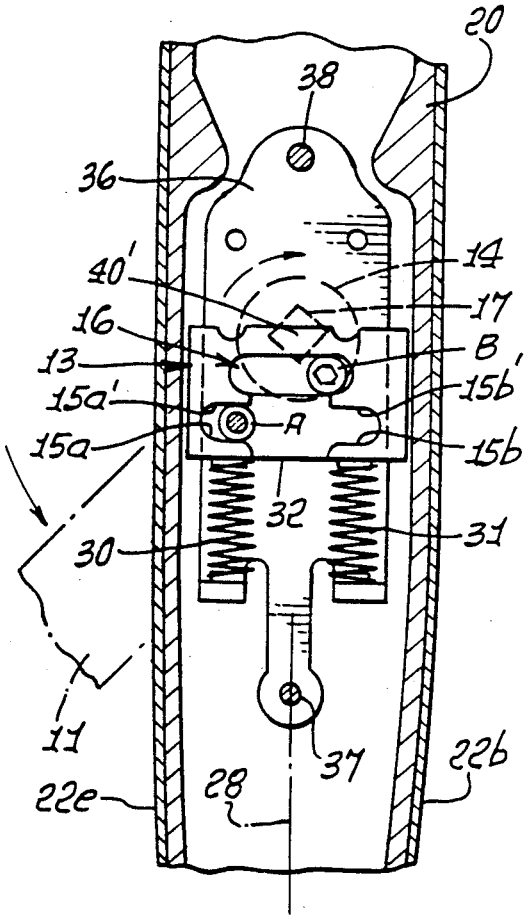
FIG. 4 is a view like FIG. 3 showing the position of elements after handle rotation.
Figure 7:
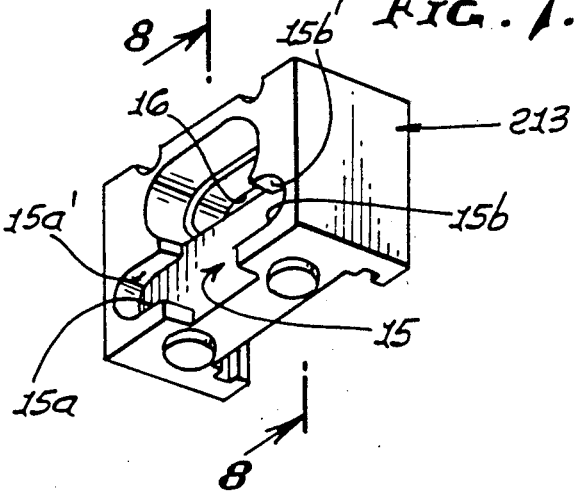
FIG. 7 is a perspective view of a sliding "window" block element.
Figure 8:
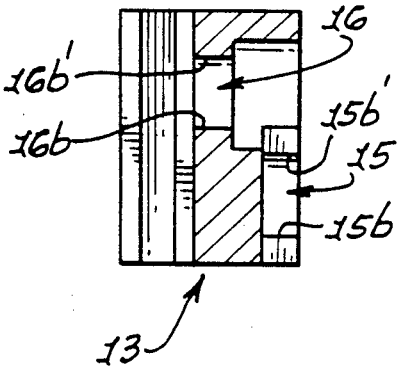
FIG. 8 is a section taken on lines 8—8 of FIG. 7.

In the above description, the handle is to be rotated downwardly and counterclockwise (FIGS. 3 and 4). The invention also enables rotation of the handle downwardly and clockwise, to open the door, and for this purpose the parts may be installed as in FIGS. 13 and 14, which correspond to FIGS. 3 and 4, but differ in the confinement of pin A between surfaces 15b and 15b' instead of between surfaces 15a and 15a'; likewise, pin B remains between surfaces 16a and 16a' during pin A movement, as seen in FIGS. 3 and 4. The parts are simply installed in the position, relative to plane 28, that correspond to the desired direction of handle displacement or turning, as shown. Note that the two grooves 15 and 16 extend in parallel, and normal to the up-down direction of handle movement of the slider block 13.

FIG. 1a shows the output shaft 17 which rotates in a door recess 46 to operate mechanism 47 that in turn retracts bolt or latch 48 from keeper 49. Different arrangements of such latches and keepers are of course possible.

Figure 5:
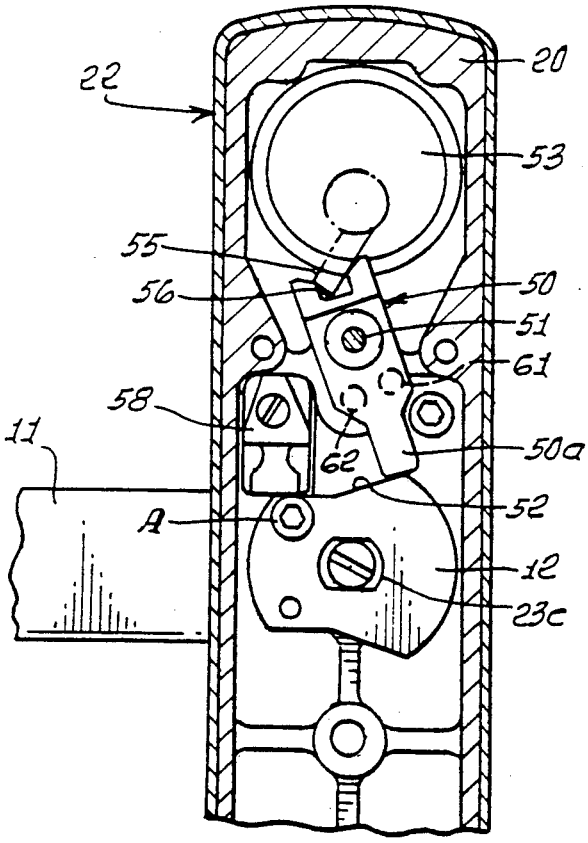
FIG. 5 is an elevation taken in section on lines 5—5 of FIG. 2, and showing elements in locked position.
Figure 6:
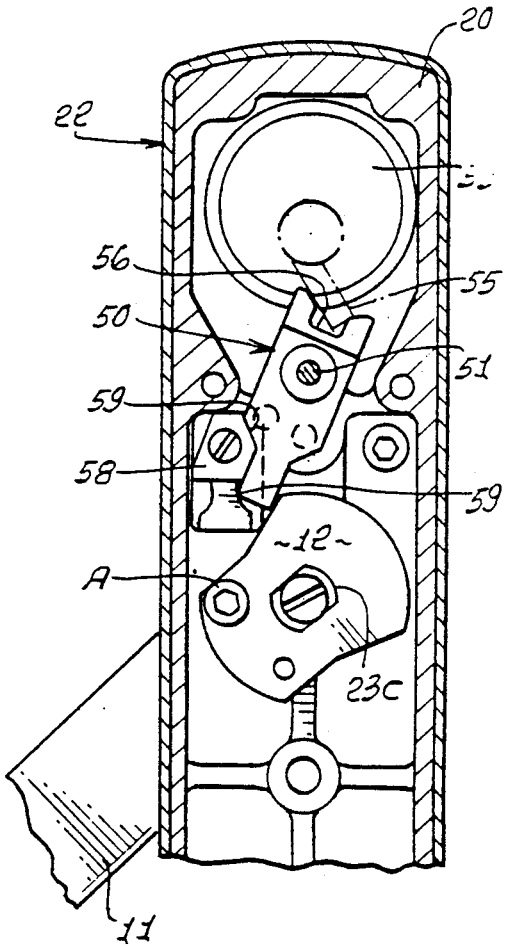
FIG. 6 is a view like FIG. 5 showing elements in unlocked position.
Figure 9:
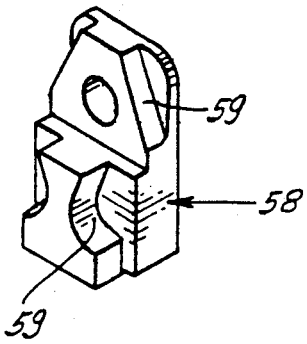
FIG. 9 is a perspective view of a "stop" block element.
Figure 10:
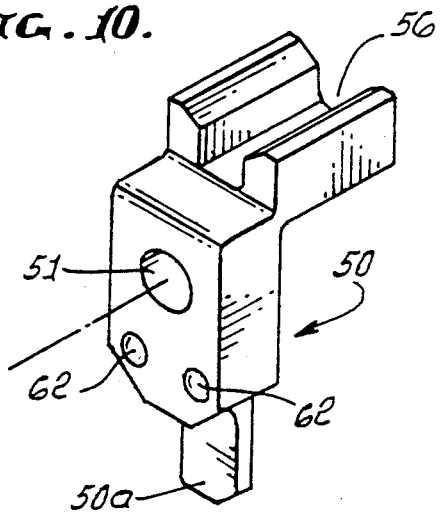
FIG. 10 is a perspective view of a lock arm element.

Also, provided by the invention is a locking part carried on the mounting means (as for example body 20) for movement into and out of locking position, wherein it blocks movement of one of the elements 12, 13, and 14. In the example shown in FIGS. 5, 6, 9, and 10, the locking part is shown in the form of an arm 50 pivoted at 51 to the body 20. When pivoted into locking position as seen in FIG. 5, the arm lower end 50a engages the flat 52 at the upper edge of the drive plate 12, preventing rotation of that plate by the handle. Arm 50 is rotatable into that position by rotation of a lock rotor 53, as by means of a key inserted and accepted into a key slot 54 in that rotor (see FIG. 1). A dog 55 on the rotor is received into a recess 56 in the upper end of the arm 50, to rotate the arm as rotor 53 is turned. When the arm is rotated into unlocking position as seen in FIG. 6, the drive rotor 12 is unblocked, and may be rotated by the handle. A stop block 58 attached to body 20 limits unblocking rotation of the arm 50 by engagement therewith at surfaces 59. A spring urged detent ball 60 in body 20 is accepted in one or the other of the notches 61 and 62 in the arm 50 when the arm arrives at one or the other position as seen in FIGS. 5 and 6, for arm locating purposes. FIGS. 13–17 correspond to FIGS. 3–6, respectively, and show parts positioned or installed (using the same mechanism) for "left-handed" handle positioning operation, instead of "right-handed" operation.

Figure 18:
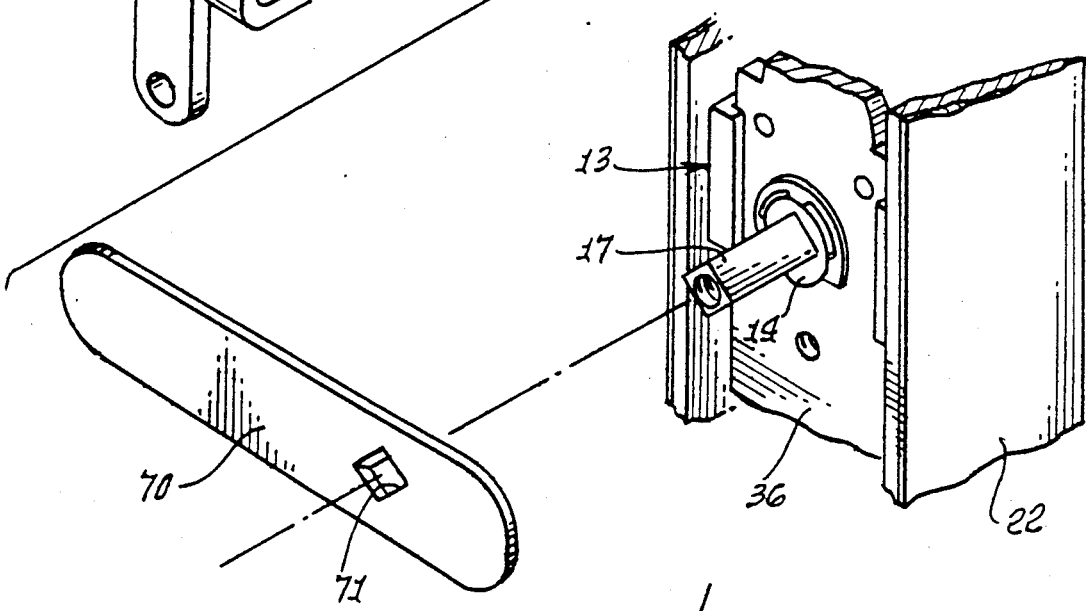
FIG. 18 is an exploded view showing use of a tool to engage and rotate the drive output (drive) shaft, to thereby shift a pin "B" in the mechanism to a position which reverses the direction of rotation at the output shaft in response to rotation of the handle.
Figure 12:
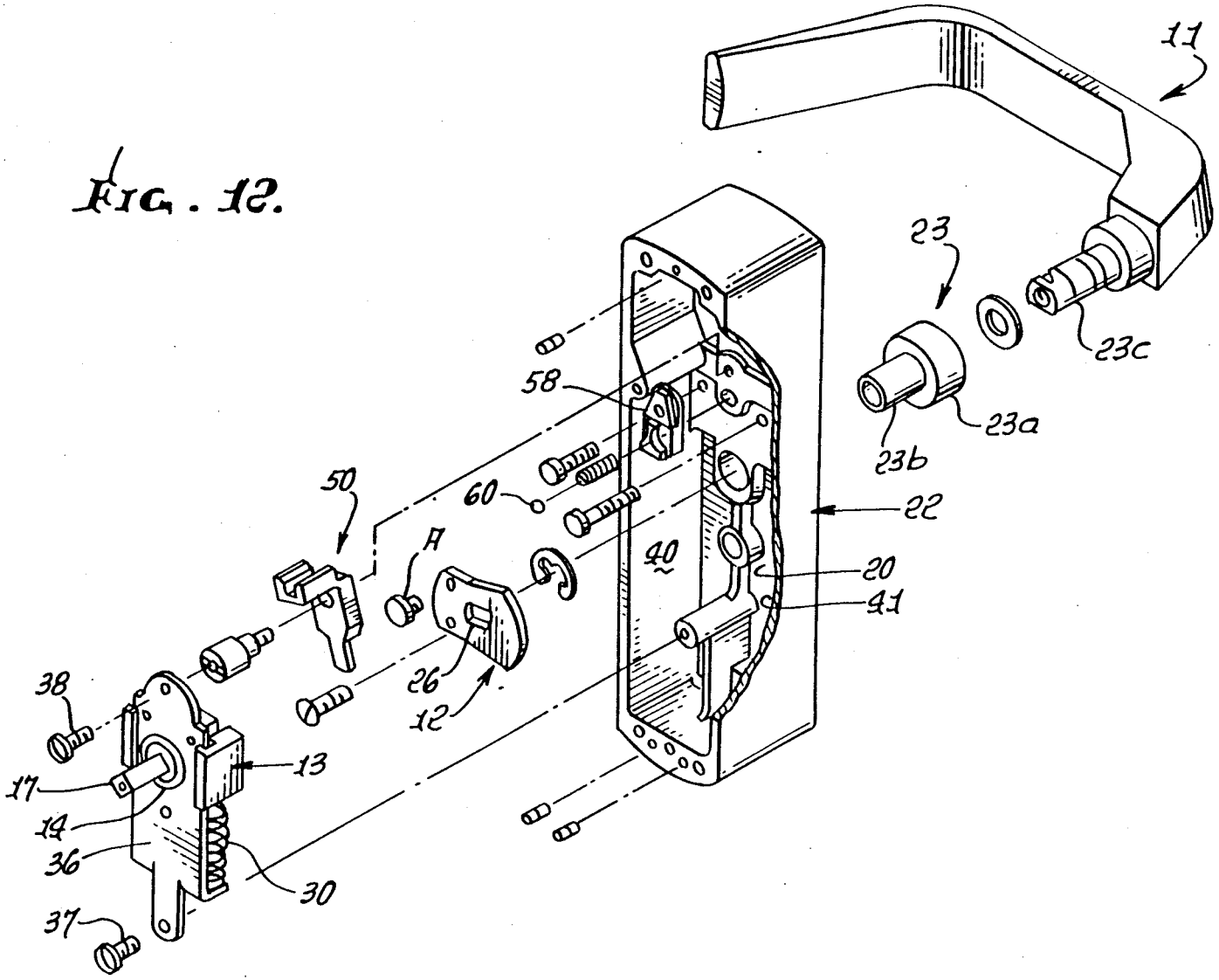
FIG. 12 is an exploded view showing all of the parts of the FIGS. 1-11 mechanism.
Figure 13:
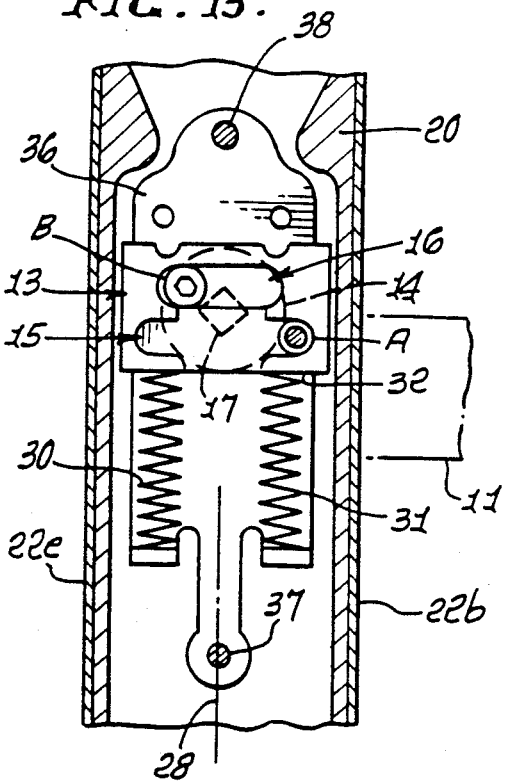
FIG. 13 is a view like FIG. 3 showing parts positioned for use when the handle is "right-handed" instead of "left handed", as in FIG. 3.
Figure 14:
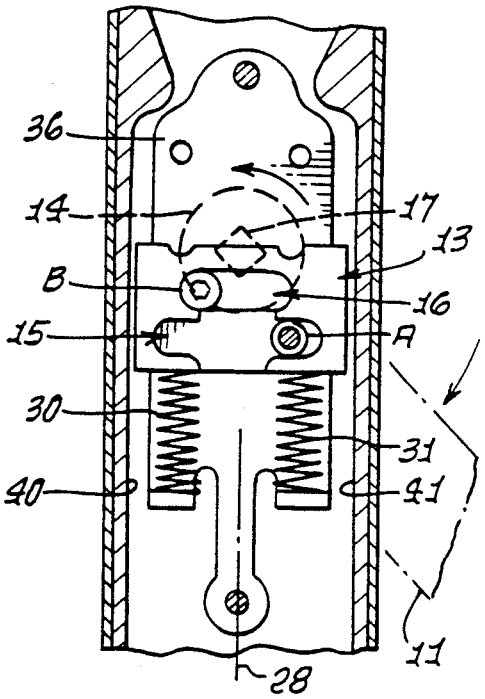
FIG. 14 is a view like FIG. 13 showing parts positioned after right-handed handle rotation, as to retract a door latch or bolt.
Figure 16:
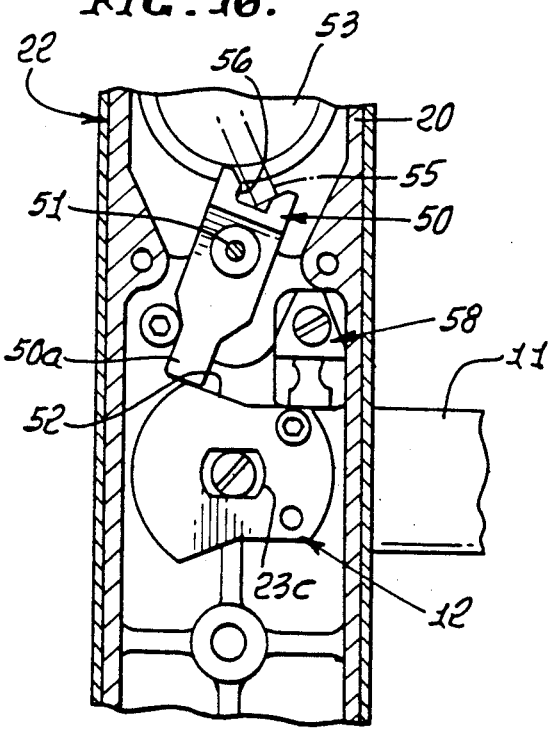
FIG. 16 is a view like FIG. 5, but showing elements positioned for left handed handle orientation, as in FIG. 13, and "locked"
Figure 17:
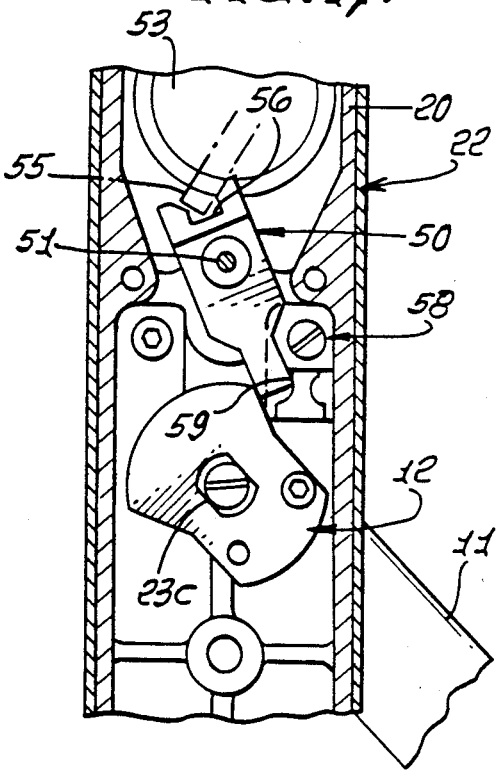
FIG. 17 is a view like FIG. 16, but showing elements in "unlocked" position.
Figure 19:
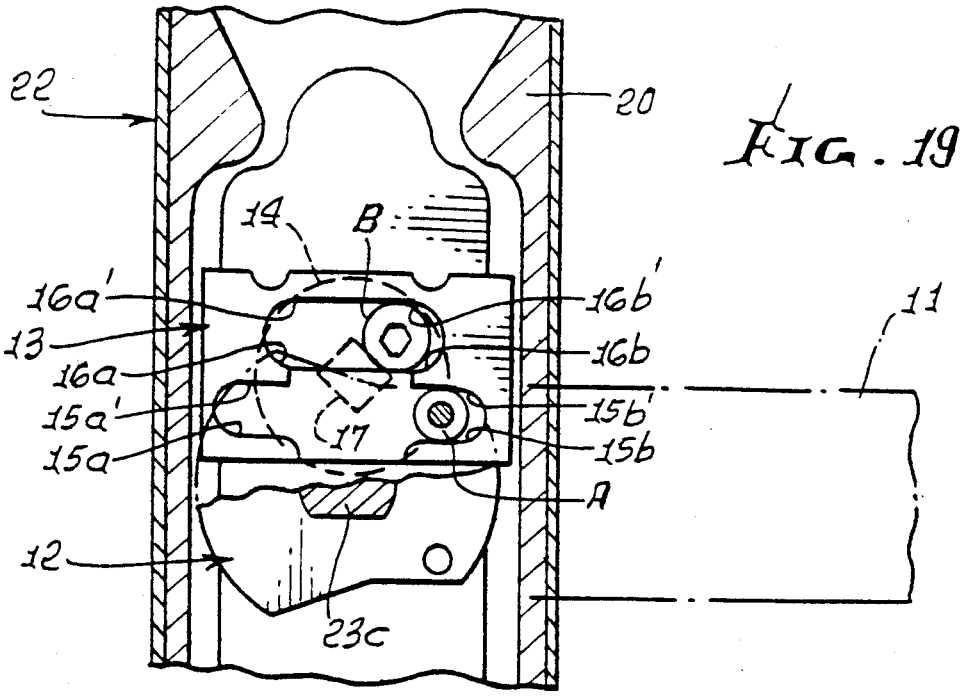
FIG. 19 is a view like FIG. 13, but showing the pin "B" in shifted position after use of the tool as in FIG. 18.

Finally, FIG. 18 shows a movable-type tool 70 having a polygonal opening 71 to be received over the polygonal cross-section output shaft 17 for rotating it and rotor 14 through a predetermined angle, such as 270° to shift pin B from FIG. 13 position, to FIG. 19 position, whereby the direction of rotation of the output shaft 17 is reversed when the handle is turned. For example, note the following:

TABLE

| | FIG. 3 | FIG. 19 |
|---|---|---|
| direction of rotation of handle 11 | counter-clockwise | clockwise |
| direction of rotation | clockwise | clockwise |

This feature accommodates the device, universally, to different latch retraction arrangements as found in different latching hardware on doors.

Figure 20:
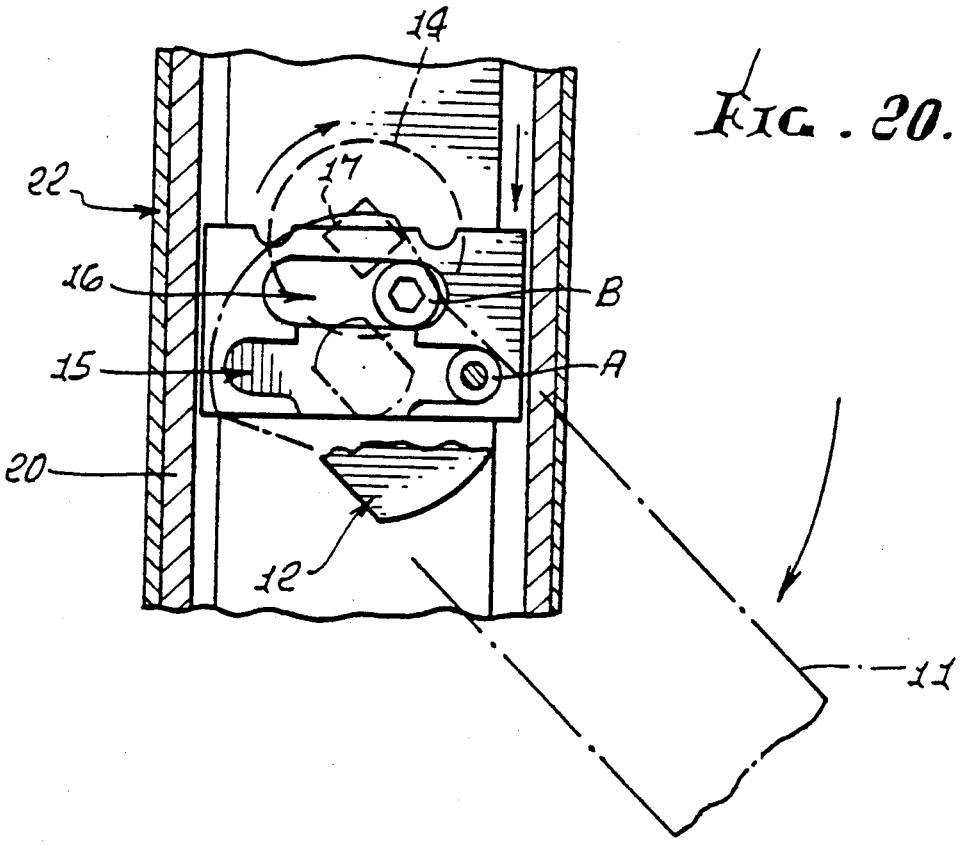
FIG. 20 is a view like FIG. 19, but showing the handle rotated and the parts displaced to effect output shaft rotation in "reverse" direction.

FIG. 20 is like FIG. 19, but shows the position of parts after the handle is rotated.

Reference is now made to FIGS. 21–32, illustrating an improved latching mechanism that is more easily operable by a handicapped or physically impaired person, while retaining certain benefits of construction and modes of operation, of the above-described apparatus referred to in FIGS. 1–20.

In FIGS. 21, 22 and 23, the handle 311 is carried by mounting means generally indicated at 320 and including a body 320a, and in such manner that the handle may be pulled (or pushed) away from (or toward) that body. See for example arrow 309 in FIG. 21 indicating that the handle is to be pulled away from body 320a in order to unlatch the door. Note that the handle 311 may have L-shape to include a first arm 311a spaced from 320a and to be manually grasped, and a second arm 311b projecting forwardly toward 320 and 320a to operatively interact with motion transfer mechanism or elements, the latter operatively interconnected between the handle and a rotary output element 317 carried by mounting means 320. FIG. 21a shows that when output element 317 is rotated in one direction (as for example clockwise), the latch operating mechanism 347 retracts a latch 348 from a keeper 349 associated with a frame 350; and when the element 317 is rotated in the opposite direction (as for example counterclockwise), the mechanism 347a retracts a latch 348a from a keeper 349a associated with a frame 350a. In other words, an added feature of the invention enables door unlatching in either direction of rotation of element 317, in response to the same direction of displacement of the handle 311 relative to body 320a (as for example pulling of the handle 311 in direction 309). Note that arm 311a extends generally vertically, and has a lower extension 311a' that extends forwardly and downwardly.

Extending the description to FIGS. 22, 23 and 26, the handle arm 311b is connected, as by a shaft 323, to an actuator 390, which is in turn pivotally connected as by a pin 391 to body part 392. Pin 391 defines a transversed axis seen at 391a, as in FIG. 32, and allows pivoting of the handle about that axis, as between unretracted position, as seen in FIG. 22, and retracted position, as seen in FIG. 23. Actuator 390 is received in and pivots in body window 320*b*. Shaft 323 includes a section 323*a* received in a counterbore 324*a* in actuator 390, and a reduced section 323*b* received in a bore 324*b* in 390. A threaded fastener 393 is received endwise in section 324*b*, and its head engages a plate 394 clamped to the actuator 390; and a second fastener 395 engages the plate and threadably connects to 390 to clamp the lower extent of the plate to 390. Plate 394 defines a polygonal aperture 394*a* to closely receive polygonal end 324*b*' of shaft 323. A lower extension 390*a* of the actuator projects forwardly into the recessed interior 325 of the body 320*a* and carries or forms a tang 390*a*' that engages a stop plate 397 on the body, to limit rearward retraction pivoting of the handle (see FIG. 23). A rubber bumper 398 is also carried by the extension 390*a* to engage the door or other auxiliary structure surface 399, thereby limiting forward displacement of the handle, in FIG. 22 position. Body part 392 is shown as connected via fasteners 392*a* to bosses 392*a*' on the body 320*a*. See FIG. 32, for example.

Extending the description to FIGS. 24 and 25, first, second and third elements (312, 313 and 314 respectively) are carried by the mounting means 320 for movement relative thereto, the first element 312 coupled or engaging the second element 313 (as for example by downwardly engaging at 312*a* the notched ledge surface or surfaces 315 of the second element); and the third element 314 also coupled to the second element 313, as for example by a tongue and groove connection—pin B' representing the tongue, and slot 316 in 313 representing the groove. Further, the second element 313 in the form of a slider is carried for bodily sliding movement in the direction of arrows 318, in response to downward displacement of the first element 312 by the door handle (in FIGS. 23 and 25); and the third element 314 being rotatable about the axis 317' of 317 in response to bodily sliding movement of the second element 313, as referred to.

The element-for-element correspondence with FIGS. 1–12 is as follows:

| Element | FIGS. 1–12 | FIGS. 21–32 |
|---|---|---|
| handle | 11 | 311 |
| mounting means | 20 (body) | 320 (body) |
| first element | 12 (drive rotor) | 312 (drive part) |
| second element | 13 (slider) | 313 (slider) |
| third element | 14 (driven rotor) | 314 (driven rotor) |
| tongue | A (pin or rotor 12) | 312 (drive part) |
| grooves/ledge | 15 | 315 (ledge) |
| tongue | B (pin 14) | B' (pin) |
| groove | 16 | 316 (slot) |
| rotary output element | 17 (shaft) | 317 (shaft) |

In FIGS. 21–37, body 320 is vertically elongated, and closely fits within a shell 322 having an outer surface 322*a*, and skirt defining side walls 322*b* and 322*e*, and end walls 322*c* and 322*d*. The shell is typically metallic and may be anodized.

The body 320 forms a recess 325 into which the parts and elements are received, as shown.

Ledge surface 315 defines a primary cam surface on element 313. Pin B', carried by the driven rotor 314, projects in laterally elongated window groove 316 defining secondary cam surface sections 316*a* and 316*b*, and also 316*a*' and 316*b*', at opposite sides of vertical plane 328 (see FIGS. 24 and 25). Groove 316 is also formed by slider block 313 as a recess therein facing leftwardly in FIG. 23. Sections 16*a* and 16*b* may be referred to as E and F sections of the transverse slot or groove 316.

Element 312 in the form of two pushers 312' seen in FIG. 32 functions as a primary cam, engaging the cam follower surface 315 in the form of two ledge notches 315', to displace block 313 downwardly as the handle is pulled rearwardly in the direction of arrow 309 in FIG. 23; and pin B' functions as a secondary cam follower, engaged by one or the other of the secondary cam surface sections E and F acting to displace pin B' downwardly (see FIGS. 24 and 25) as the block is displaced downwardly by the pushers 312' (corresponding to pin A in FIGS. 1–12). Such downward displacement of the block is yieldably resiliently resisted by the two compression springs 330 and 331 endwise confined between the undersurface 332 of the block 313, and ledges 334 and 335. The latter project from a mounting plate 336 attached via fasteners 337 and 338 to body 320. Plate 336 extends in a plane parallel to up-down movement of element 313, the latter slidably guided in its movement adjacent plate 336, as by guides 313*e* and 313*f* embracing edges of 336 (see FIG. 32). As the handle is pulled rearwardly, slider 313 moves downwardly, and pin B' is displaced downwardly to rotate rotor 314 about its axis 317', i.e., the axis of output shaft 317, whereby pin B is also displaced from FIG. 24 to FIG. 25 position in groove section 316*a* and 316*a*'. As the rearwardly displaced handle is released, the springs 330 and 331 act to return block 313 upwardly to FIG. 22 position.

In the above description, the output shaft 317 is rotated, say, clockwise as the handle is pulled in direction 309. The shaft may alternatively be caused to rotate counterclockwise as the handle is pulled in direction 309, as referred to in connection with FIG. 21*a*. This is accomplished by fitting a tool with a polygonal opening on the polygonal shaft 317 for rotating it, and rotor 314, through a predetermined angle, to a shift pin B from reception in groove section 316*a* and 316*a*' into groove section 316*b* and 316*b*'. This feature accommodates the device universally to different latch retraction arrangements, as found in different latching hardware on doors.

Finally, the invention also provides a locking part carried on the mounting means for movement into and out of locking position, in which it blocks handle displacement relative to the mounting means. In the example seen in FIGS. 26–31, the locking part or arm 350 is pivoted to the support bracket 392, as by means of fastener 351, and having an axis 365 of pivoting which projects away from the body. When pivoted into locking position (FIG. 27), the lower end portion 350*a* of the arm registers with a slot 366 in support bracket 392, so as to prevent passage into or through the slot of a tongue or stop 367 upstanding on the actuator 390, above pivot pin 391; however, when the locking arm is pivoted into FIG. 26 position, the slot 366 is uncovered, so as to freely pass the tongue 367 traveling forwardly as the handle is retracted into FIG. 23 position. Accordingly, the handle can be locked against door opening displacement, or it can be freed for such displacement. A detent ball 368 is urged by a spring 369 toward and against depressions 370 in the arm 350 to frictionally (yet releasably) hold the arm in locked or unlocked positions. See FIG. 28. Arm 350 is rotatable as by a key inserted and accepted into a key slot 354 in a lock rotor 353. Dog 355 on the rotor is received in a recess 356 in the upper end of arm 350 to pivot the arm, as described.

Threaded openings 374 and 375 in the body 320 are adapted to receive fasteners that retain the body to door structure.

The modified invention, as seen in FIG. 21–32, is addressed to needs required on left hand reverse, and right hand reverse doors; that is, doors which open "out" of a building. Current practice requires first a rotation of either a knob or lever, and then a pulling force to open the door, i.e., two motions. This is extremely difficult for handicapped people.

The modified invention reduces the above two operations to a single motion serving to both release the locking device and to open the door. Such single motion functioning permits use of an appliance, such as the hooked end of a cane, to pull a handle to both release the lock and open the door.

Further, the modified invention affords excellent mechanical advantages, which reduces the force required for lock release, thus further enhancing ease of use by the physically impaired. Also, the design eliminates "pinch points" as the handle pivots out of and back into the body 320.

I claim:

1. In apparatus for transferring door opening or closing motion in response to displacement of a door handle, the combination comprising (a) a mounting means, (b) the door handle carried by the mounting means for push or pull displacement toward or away from the mounting means, (c) a rotary output element carried by the mounting means, (d) and motion transfer elements co-operable between the handle and said output element to effect rotation of the output element in response to said displacement of the door handle, (e) said motion transfer elements include first, second and third elements carried by the mounting means, for movement relative thereto, the first and third elements coupled to the second element, the second element carried by the mounting means for bodily movement in response to displacement of the first element by the door handle, the third element being rotatably in response to bodily movement of the second element, said rotary output element connected to the third element.

2. The combination of claim 1 wherein the handle has L-shape, including a first arm to be manually grasped, and a second arm projecting toward the mounting means, and a pivot connecting the second arm to the mounting means and extending transversely of the second arm whereby the first arm may be pulled away from the mounting means or displaced toward the mounting means.

3. The combination of claim 1, wherein the first element is connected with the handle to be rotated thereby.

4. The combination of claim 1 wherein at least two of the first, second and third elements have alternative coupling positions characterized in that in one position the output element is rotated clockwise when the handle is displaced away from the mounting means; and in the other position, the output element is rotated counterclockwise when the handle is displaced away from the mounting means.

5. The combination of claim 4 including a locking part carried on the mounting means for movement into and out of locking position in which it blocks said displacement of said handle relative to the mounting means.

6. The combination of claim 5 wherein the locking part has pivoted attachment to said mounting means.

7. The combination of claim 6 wherein the locking part has an axis of pivoting which projects away from said mounting means.

8. The combination of claim 1 wherein said second element is carried by said mounting means for linear movement relative thereto.

9. The combination of claim 8 including spring means urging said second element in a direction to yieldably oppose rotation of the first element by the handle.

10. The combination of claim 1 wherein the first and second elements have primary cam and cam follower surfaces, and the second and third elements have secondary cam and cam follower surfaces.

11. The combination of claim 10 wherein the secondary cam surface has E and F sections, the secondary cam follower engaging the E section when the output element is to be rotated clockwise, and the secondary cam follower engaging the F section when the output element is to be rotated counterclockwise.

12. The combination of claim 1 wherein the first element is connected with the handle to be rotated thereby, and the third element is connected with the rotary output element in the form of a shaft, to rotate the shaft.

13. The combination of claim 12 wherein the second element is a linearly movable slider having grooves in which a pin B′ is received and is carried by the third element.

14. The combination of claim 13 wherein said grooves, which receive said B′ pin are normal to the direction of linear movement of said slider.

15. The combination of claim 14 wherein said grooves include two sections, respectively at opposite sides of the plane bisecting the grooves, the pin B′ being adjustably shiftable between said sections, to reverse the direction of rotation of the rotary output element in response to said displacement of the handle in a predetermined direction.

16. The combination of claim 11 wherein the surfaces E and F are carried on the second element, are offset laterally, and extend laterally.

17. The combination of claim 4 including detent means carried by at least one of the mounting means and locking part for resisting said movement of the locking arm into and out of said locking position.

* * * * *